US007523704B2

(12) United States Patent
Domotor

(10) Patent No.: US 7,523,704 B2
(45) Date of Patent: Apr. 28, 2009

(54) LITHOGRAPHIC OFFSET PRESS AND LITHOGRAPHIC OFFSET PRESS PRINTING METHOD

(76) Inventor: Julius Domotor, 381 Courtland Dr., San Bruno, CA (US) 94066

( * ) Notice: Subject to any disclaimer, the term of this patent is extended or adjusted under 35 U.S.C. 154(b) by 0 days.

(21) Appl. No.: 11/655,303

(22) Filed: Jan. 19, 2007

(65) Prior Publication Data

US 2008/0173194 A1 Jul. 24, 2008

(51) Int. Cl.
*B41F 7/02* (2006.01)
*B41F 7/24* (2006.01)

(52) U.S. Cl. ..... 101/450.1; 101/142; 101/147; 101/492; 101/217

(58) Field of Classification Search ..... 101/127, 101/450.1, 451, 147, 457, 148, 350.2, 142, 101/132.5, 217
See application file for complete search history.

(56) References Cited

U.S. PATENT DOCUMENTS 3,603,254 A * 9/1971 Siebke ..... 101/148
4,308,796 A * 1/1982 Satterwhite ..... 101/143
4,421,027 A * 12/1983 Fischer ..... 101/142
4,766,809 A * 8/1988 Giori et al. ..... 101/152
4,796,556 A * 1/1989 Bird ..... 118/46
4,808,443 A * 2/1989 Minamoto et al. ..... 427/407.1
5,463,951 A * 11/1995 Waizmann et al. ..... 101/423
5,797,326 A * 8/1998 Buschulte et al. ..... 101/483

FOREIGN PATENT DOCUMENTS

GB 2119711 A * 11/1983

* cited by examiner

*Primary Examiner*—Leslie J Evanisko
*Assistant Examiner*—Matthew Marini
(74) *Attorney, Agent, or Firm*—Thomas R. Lampe

(57) ABSTRACT

An offset lithography printing press and method wherein dampening structure applies a thin moisture layer directly to a blanket cylinder to facilitate separation between the blanket cylinder and paper or other printable sheet material when passing through a nip between the blanket cylinder and an impression cylinder.

7 Claims, 2 Drawing Sheets

LITHOGRAPHIC OFFSET PRESS AND LITHOGRAPHIC OFFSET PRESS PRINTING METHOD

TECHNICAL FIELD

This invention relates to the field of offset lithography, and more particularly to an offset lithography press and a lithographic offset press printing method.

BACKGROUND OF THE INVENTION

The operation of lithographic printing presses involves an interaction of water and ink and the inking system of the lithographic printing presses has not changed to any appreciable degree since the invention of the offset lithographic press in the early twentieth century.

My co-pending U.S. patent application Ser. No. 11/514,002, filed Aug. 30, 2006, relates to an offset lithography press and method for improving the performance of an offset lithography press wherein misting is virtually eliminated even at very high operational speeds.

While the invention disclosed in the above-identified application effectively solves misting problems, conventional offset lithography presses have another drawback relating to the dampening systems employed.

On a conventional lithographic offset press the rotating plate cylinder directly receives from a dampening unit engaging the plate cylinder a thin water layer that adheres to a non-printing surface such as an aluminum surface. The ink rollers of the press will deposit ink only where an impression or image layer, typically a polymer layer, has been applied to create a printing area. The non-printing area with the wafer-thin moisture layer refuses to take on ink.

As the plate cylinder rolls into contact with the adjacent blanket cylinder of a lithographic offset press, the ink is transferred to a blanket cylinder. Typically, the blanket cylinder is formed of steel and includes a rubber layer covering the steel. The blanket cylinder is in contact with an impression cylinder, typically formed of steel, which carries the paper receiving the ink from the blanket cylinder.

In the prior art systems described above, moisture directly applied to the plate by a dampening unit will evaporate as the plate cylinder passes in engagement with the inking rollers, and by the time contact is made with the blanket cylinder, the moisture has essentially disappeared. When the blanket cylinder contacts the paper it is almost dry and the paper wants to adhere to the blanket cylinder. The paper has a difficult time separating from the blanket cylinder and it is very noisy when separation occurs. In many instances the paper or particles thereof stick to the blanket cylinder to a sufficient degree to cause serious problems.

DISCLOSURE OF INVENTION

The present invention relates to a lithographic offset press in which the afore-recited difficulties are not encountered. The unique method of the invention also accomplishes this objective.

Utilizing the teachings of the present invention, release of the paper or other printable sheet material from the blanket cylinder is readily accomplished. Ripping noises are not encountered and the paper or other printable sheet material does not tend to stick to the blanket cylinder. Furthermore, the blanket cylinder stays cleaner than when conventional approaches are employed, and paper particles do not readily stick to the blanket cylinder.

The lithographic offset press of the present invention includes a rotatable plate cylinder and ink applicator structure for applying ink to the plate cylinder.

A blanket cylinder engages the plate cylinder at a location spaced from the ink applicator structure and the blanket cylinder is rotatable with the plate cylinder. The blanket cylinder is for receiving ink from the plate cylinder previously applied to the plate cylinder by the ink applicator structure.

The press also includes dampening structure spaced from the plate cylinder for applying moisture directly to the blanket cylinder, rotation of the blanket cylinder transporting the moisture into engagement with the plate cylinder.

A rotatable impression cylinder is adjacent to the blanket cylinder for delivering paper or other printable sheet material therebetween for receiving ink previously applied to the blanket cylinder by the plate cylinder. The paper or other printable sheet material also receives moisture previously directly applied to the blanket cylinder by the dampening structure.

The lithographic offset press printing method of the invention includes the step of rotating a plate cylinder and during rotation of the plate cylinder, applying ink to the plate cylinder.

After the step of applying ink to the plate cylinder and during continued rotation of the plate cylinder, ink is transferred from the plate cylinder to a rotating blanket cylinder engaging the plate cylinder.

Dampening structure is positioned adjacent to the blanket cylinder and spaced from the plate cylinder.

The dampening structure is utilized to directly apply moisture to the rotating blanket cylinder. The rotating blanket cylinder is utilized to deliver the ink transferred thereto by the plate cylinder to paper or other printable sheet material.

Moisture applied to the blanket cylinder is employed to facilitate separation between the paper or other printable sheet material and the blanket cylinder when ink is transferred to the paper or other printable sheet material.

Other features, advantages and objects of the present invention will become apparent with reference to the following description and accompanying drawings.

BEST MODE FOR CARRYING OUT THE INVENTION

Figure 2:
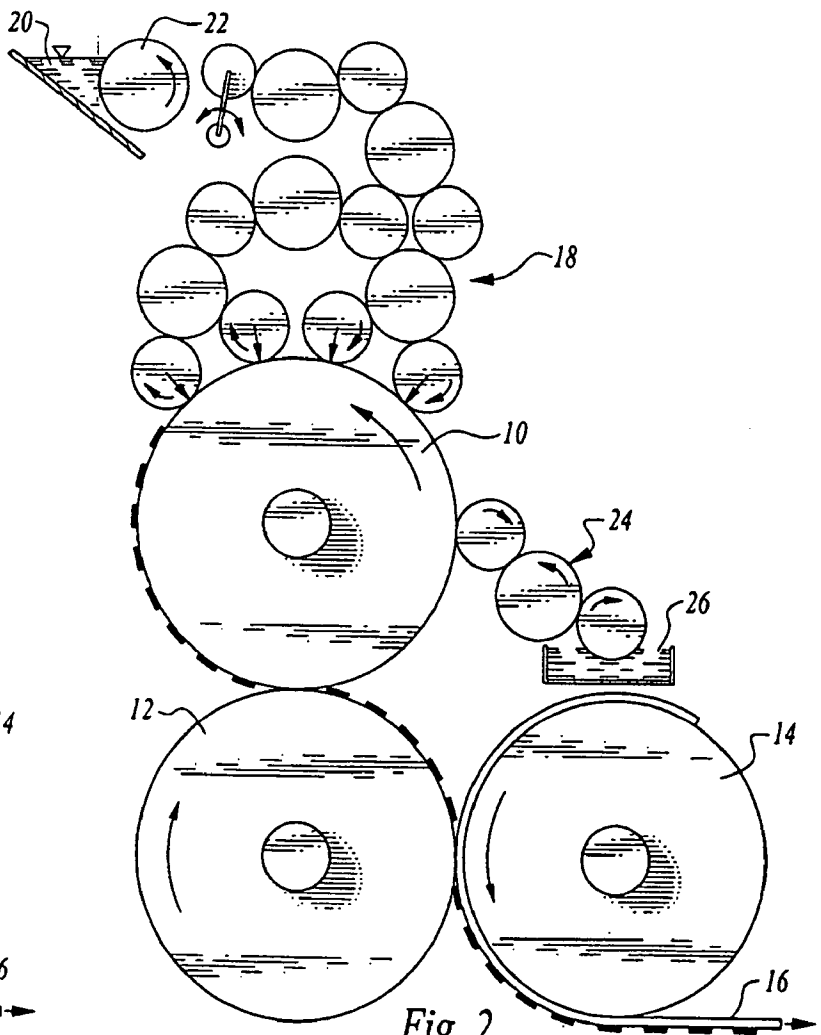
Fig. 2 (Prior Art)
FIG. 2 is a schematic presentation of a typical offset lithography press construction wherein a dampening unit applies moisture directly to a plate cylinder prior to transfer of ink to the plate cylinder by an inking unit.

FIG. 2 illustrates a typical offset lithography press, the press including a rotating plate cylinder 10 which carries the image, a blanket cylinder 12 which transfers ink to paper, and an impression cylinder 14 which carries paper 16 that receives ink from the blanket cylinder. The press also includes an inking unit 18 having an ink fountain 20 and an ink supply roll 22. As is conventional, a plurality of inking unit rollers are in operative association with the rotatably driven plate cylinder 10 to selectively deliver ink from the ink fountain and ink supply roll to the plate cylinder. The physical make-up, configuration and numbers of these rollers in an inking unit vary in prior art arrangements.

The prior art arrangement shown in FIG. 2 also includes a dampening unit 24 including a water supply 26 and rollers for applying moisture to the plate cylinder upstream of the inking unit. The moisture is typically in the form of a thin water layer that adheres to a non-printing aluminum surface of the plate cylinder. The inking unit rollers deposit ink only where a polymer layer forming the image has been applied. The non-printing area with the wafer thin moisture refuses to take on ink. As the plate cylinder rolls into contact with the adjacent blanket cylinder 12 the ink is transferred to the blanket cylinder surface. The blanket cylinder is typically formed of steel and includes an outer rubber layer.

In the prior art the rotating blanket cylinder 12 brings the ink into contact with paper 16 on adjacent impression cylinder 14 to print the desired image on the paper.

In the prior art arrangement just described, water applied to the plate cylinder by the dampening unit 24 evaporates at a rapid rate during passage under the inking unit. Typically, for example, only 30-40 percent water may remain. Furthermore, only half of even this residual moisture is actually passed on to the rubber surface of the blanket cylinder by the plate cylinder. This may then result in, for example, 15% of the water applied by the dampening unit to the plate cylinder actually staying with the blanket cylinder at the time contact is made with the paper on the impression cylinder. This causes problems separating the paper from the blanket cylinder, with resultant high noise level and sticking of portions of the paper or particles thereof to the blanket cylinder, causing considerable problems.

FIGS. 3A-3E show other typical dampening unit configurations 24A-24E, all of which are characterized by the fact that they apply moisture directly to their respective associated plate cylinder.

Figure 1:
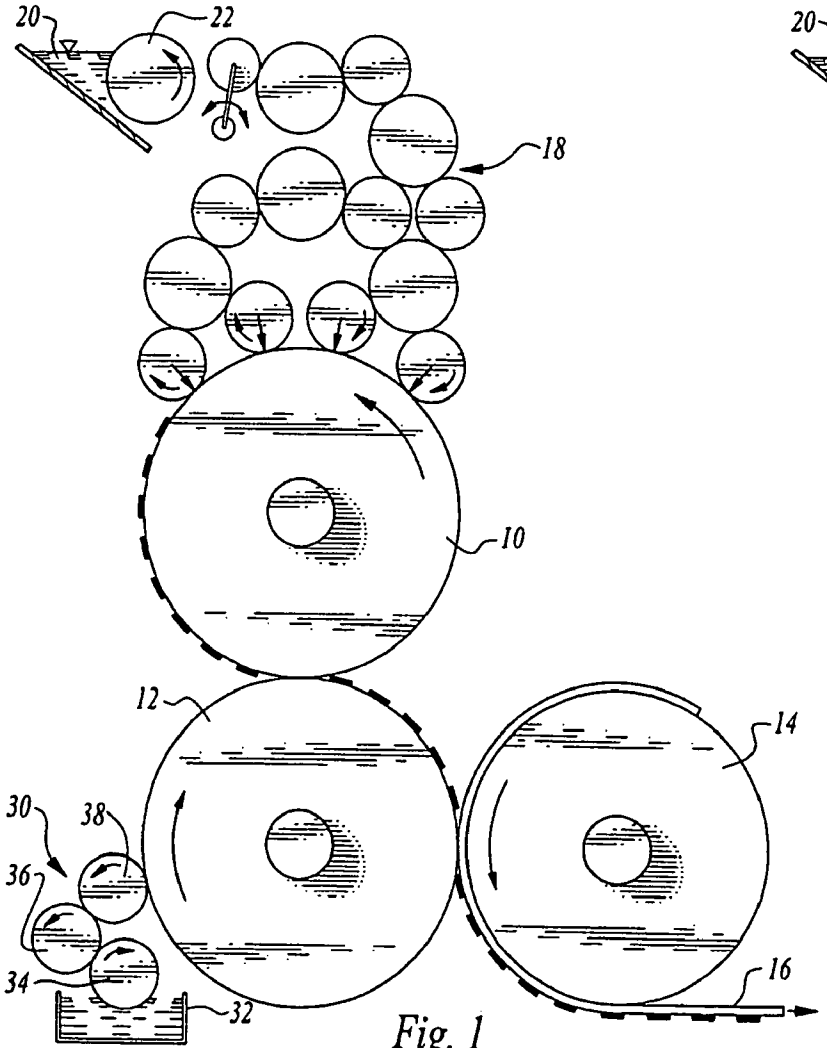
FIG. 1 is a schematic presentation of a lithographic offset press constructed in accordance with the teachings of the present invention.
Figure 3A:
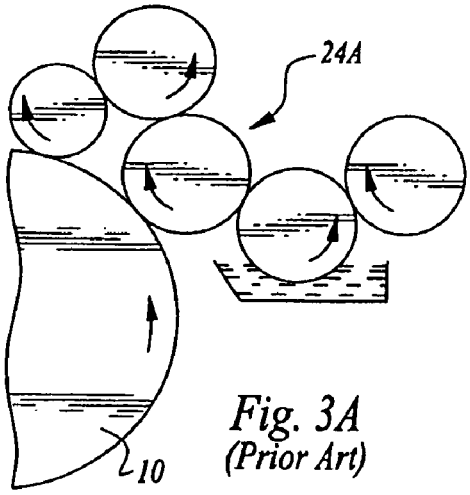
Fig. 3A (Prior Art)
FIGS. 3A-3E show other typical prior art arrangements wherein dampening units apply moisture directly to the plate cylinder, the numbers and locations of the rollers in the dampening unit differing and being further representative of the nature of such arrangements.
Figure 3B:
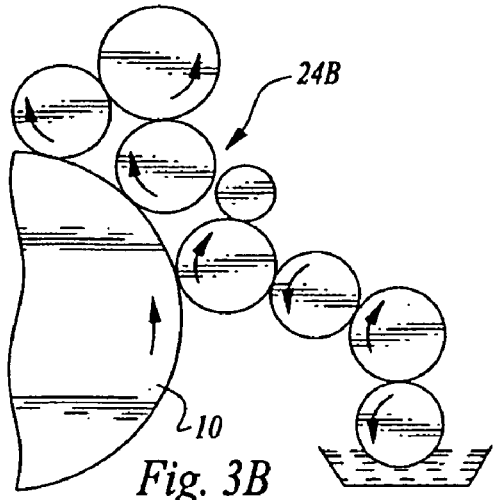
Fig. 3B (Prior Art)
Figure 3C:
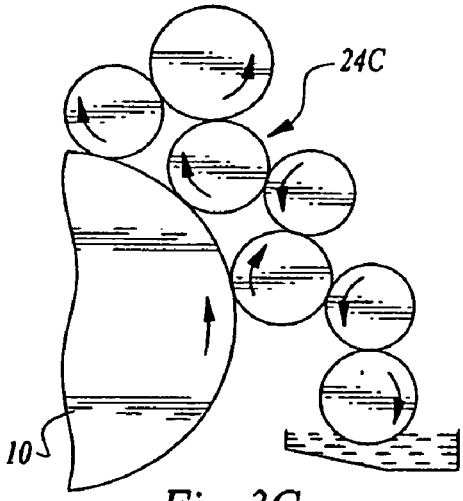
Fig. 3C (Prior Art)
Figure 3D:
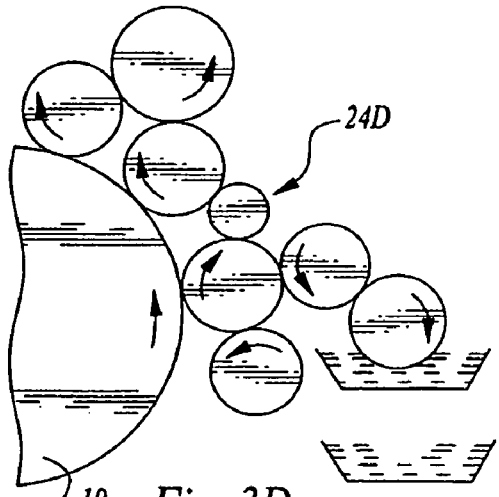
Fig. 3D (Prior Art)
Figure 3E:
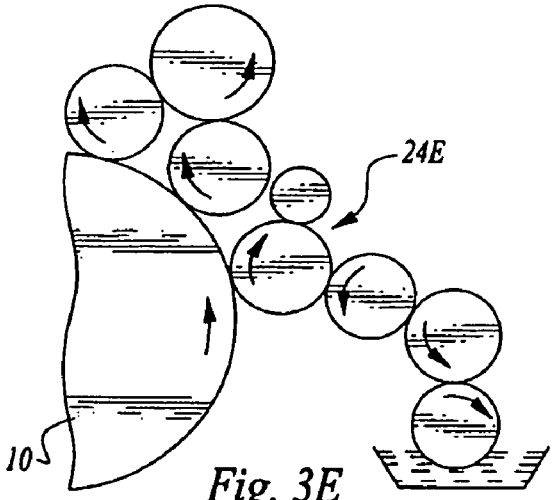
Fig. 3E (Prior Art)

FIG. 1 illustrates a lithographic offset press constructed in accordance with the teachings of the present invention. As in the typical prior art lithographic offset press, the disclosed embodiment of the invention includes a plate cylinder 10, a blanket cylinder 12 and an impression cylinder 14. An inking unit 18 transfers ink to the plate cylinder so that an ink image is formed, the ink image being represented by the blackened spaced rectangles depicted in FIG. 1. Upon contact with the outer surface of the blanket cylinder 12, the ink image is transferred thereto and upon continued rotation of the blanket cylinder, the ink engages and is transferred to paper 16 transported by impression cylinder 14.

In the FIG. 1 embodiment, a dampening unit does not apply moisture directly to the plate cylinder. Instead, a dampening unit 30 directly applies a thin layer of moisture, such as a thin water layer, to the outer surface of the blanket cylinder 12. This application occurs upstream of the nip formed between the blanket cylinder and the plate cylinder. In the illustrated arrangement, the dampening unit 30 includes a water supply 32, a chrome roller 34, a rubber roller 36, and another chrome roller 38, the latter being in direct contact with the rubber surface of the blanket cylinder, the rubber layer, for example, being typically, but not necessarily, in the order of 3/32 in. thick. Alternatively, rollers 34, 38 could be rubber rollers and roller 36 could be a chrome roller.

When the thin layer of moisture reaches the nip between plate cylinder 10 and blanket cylinder 12, a first portion of the moisture on the rotating blanket cylinder is transferred to the plate cylinder, while a second portion of the moisture on the rotating blanket cylinder remains thereon. The result may be for example that half of the moisture gets transferred to the plate cylinder while the other half remains on the blanket cylinder, the percentage split of course depending upon many factors such as the nature of the material at the outer surfaces of the plate and blanket cylinders. In any event, a significant amount of moisture remains on the blanket cylinder between the voids of the ink image. The excess moisture present at the time the blanket cylinder contacts the paper will promote smooth and easy release of the paper from the blanket cylinder. The conventional prior art ripping noise goes away and paper and paper particles are not likely to stick to the blanket cylinder. In practice, a certain amount of water will remain on the blanket cylinder after the ink is transferred to the paper or other printing medium.

The invention claimed is:

1. A lithographic offset press including, in combination:

a rotatable plate cylinder;

ink applicator structure for applying ink to said plate cylinder;

a blanket cylinder engaging said plate cylinder at a location spaced from said ink applicator structure and said blanket cylinder rotatable with said plate cylinder, said blanket cylinder for receiving ink from said plate cylinder at said location previously applied to said plate cylinder by said ink applicator structure;

dampening structure spaced from said plate cylinder for applying a thin layer of water suitable for lithographic printing directly to said blanket cylinder upstream of said location, rotation of said blanket cylinder transporting said thin layer of water from said dampening structure to said location and into engagement with said plate cylinder at said location to transfer a first portion of the water previously directly applied to said blanket cylinder by said dampening structure to said plate cylinder, said plate cylinder during rotation thereof operable to transport said first portion to said ink applicator structure; and a rotatable impression cylinder adjacent to said blanket cylinder for delivering paper or other printable sheet material between said impression cylinder and said blanket cylinder for receiving ink previously applied to said blanket cylinder by said plate cylinder and for receiving a second portion of the water previously directly applied to said blanket cylinder by said dampening structure to facilitate separation of said paper or other printable sheet material from said blanket cylinder.

2. The lithographic offset press according to claim 1 wherein said blanket cylinder includes an outer surface formed of rubber or other suitable material operable to transfer said first portion of the water on said blanket cylinder to said plate cylinder upon rotation of said plate cylinder and said blanket cylinder to dampen said plate cylinder and to retain said second portion of said water from said blanket cylinder until said second portion of said water engages said paper or other printable sheet material.

3. A lithographic offset press printing method comprising the steps of:

rotating a plate cylinder;

during rotation of said plate cylinder, employing ink applicator structure to apply ink to said plate cylinder;

after the step of applying ink to the plate cylinder and during continued rotation of the plate cylinder, transferring said ink from said plate cylinder to a rotating blanket cylinder at a location where said blanket cylinder engages said plate cylinder;

positioning dampening structure adjacent to said blanket cylinder and spaced from said plate cylinder;

utilizing said dampening structure to apply a thin layer of water suitable for lithographic printing directly to said rotating blanket cylinder upstream of said location;

utilizing said rotating blanket cylinder to deliver water applied directly thereto by said dampening structure to said location and into engagement with said plate cylinder whereby a first portion of water directly applied to said blanket cylinder by said dampening structure is transferred to said plate cylinder and delivered to said ink applicator structure by rotation of said plate cylinder;

utilizing said rotating blanket cylinder to deliver the ink transferred thereto by said plate cylinder to paper or other printable sheet material; and employing a second portion of the water applied directly to said blanket cylinder by said dampening structure to facilitate separation between said paper or other printable sheet material and said blanket cylinder when ink is transferred to said paper or other printable sheet material.

4. The method according to claim 3 wherein said blanket cylinder and said plate cylinder form a nip, said first portion of the water on the blanket cylinder being transferred to said plate cylinder at said nip.

5. The method according to claim 3 wherein said first portion constitutes 50% or about 50% of the water transferred to said plate cylinder by said blanket cylinder.

6. The method according to claim 3 including the step of retaining some of said second portion of the water on the blanket cylinder after said ink is transferred to said paper or other printable sheet material.

7. The method according to claim 3 wherein said paper or other printable sheet material is delivered to said blanket cylinder by an impression cylinder adjacent to said blanket cylinder.

* * * * *